US010272577B2

(12) United States Patent
Corner et al.

(10) Patent No.: US 10,272,577 B2
(45) Date of Patent: Apr. 30, 2019

(54) HAT WITH MULTIFUNCTIONAL BILL PORTION

(71) Applicants: William Corner, Hebron, MD (US); Glen Odor, Ocean City, MD (US)

(72) Inventors: William Corner, Hebron, MD (US); Glen Odor, Ocean City, MD (US)

( * ) Notice: Subject to any disclaimer, the term of this patent is extended or adjusted under 35 U.S.C. 154(b) by 70 days.

(21) Appl. No.: 15/280,731

(22) Filed: Sep. 29, 2016

(65) Prior Publication Data

US 2017/0086527 A1 Mar. 30, 2017

Related U.S. Application Data

(60) Provisional application No. 62/234,579, filed on Sep. 29, 2015.

(51) Int. Cl.

| | |
|---|---|
| ***A42B 1/06*** | (2006.01) |
| ***B26B 11/00*** | (2006.01) |
| ***B67B 7/16*** | (2006.01) |
| ***A63B 57/50*** | (2015.01) |
| ***A42B 1/24*** | (2006.01) |

(52) U.S. Cl.

CPC ..... *B26B 11/00* (2013.01); *A42B 1/062* (2013.01); *A42B 1/24* (2013.01); *A63B 57/50* (2015.10); *B67B 7/16* (2013.01)

(58) Field of Classification Search

CPC ..... B26B 11/00; A42B 1/24; A42B 1/062; A42B 1/241; A42B 1/248; A42B 1/064; A42B 1/205; A42B 1/206; A42B 1/242; A42B 1/244; A42B 1/245; A42B 1/247; A63B 57/50; B67B 7/16

USPC ..... 2/209.13, 195.1, 10

See application file for complete search history.

(56) References Cited

U.S. PATENT DOCUMENTS

| | | | | |
|---|---|---|---|---|
| 3,310,879 | A * | 3/1967 | Brzezinski | A63B 47/008 15/237 |
| 4,535,987 | A * | 8/1985 | Dikoff | A63B 57/00 116/225 |
| 5,487,191 | A * | 1/1996 | Ridley | A42B 1/062 2/10 |
| 6,174,058 | B1 * | 1/2001 | Hsiao | A42B 1/062 2/10 |
| 6,357,051 | B1 * | 3/2002 | Lee | A42B 1/201 2/195.1 |
| 7,640,601 | B2 * | 1/2010 | Lee | A42B 1/063 2/195.1 |
| 2011/0030124 | A1 * | 2/2011 | Zhen | A42B 1/24 2/209.13 |
| 2014/0026297 | A1 * | 1/2014 | Enes | A01K 97/00 2/410 |

* cited by examiner

*Primary Examiner* — Nathan E Durham
*Assistant Examiner* — Abby M Spatz
(74) *Attorney, Agent, or Firm* — Patwrite Law; Mark David Torche

(57) ABSTRACT

A hat with multifunctional bill portion has a sheath portion and a top sheath attachment portion is fitted over bill of a hat that has been trimmed to fit. A plurality of screws attach the multifunctional bill portion to the bill. The sheath has two magnets and an alignment portion to removably hold a bill tool such as a knife in place. The alignment portion fits within a matching finger portion of the bill tool and helps stabilize the tool within the multifunctional bill portion during use. A variety of bill tool portions may be selected to match a specific use such as knife, bottle cap opener, divot tool, wrench, screwdriver, etc.

10 Claims, 8 Drawing Sheets

HAT WITH MULTIFUNCTIONAL BILL PORTION

CROSS REFERENCE TO RELATED APPLICATIONS

This application claims priority and herein incorporates by reference U.S. provisional patent application 62/234,579, filed Sep. 29, 2015.

BACKGROUND OF THE INVENTION

Knives have been used since before recorded history and have been essential in the human struggle to survive and thrive. Early knives were made of naturally occurring materials such as rock, bone or other hard substances. The development of our ability to work with metal through the bronze and iron ages saw great improvement in the field of knives.

Modern knives are generally made of steel and have many shapes and sizes designed to meet specific needs. The need to have a knife available yet able to be carried safely gave rise to the pocket knife. The earliest pocket knife we have today dates from around 600 to 500 BCE.

While pocket knives can be carried safely, they require a pocket and they must be opened before use which is not always convenient. Additionally, it may be desirable to conveniently carry other necessary tools such as bottle opener or golf divot tool or other small tool such as a bicycle wrench etc. without the need to have a pocket.

There is a need for way to carry a knife or other small tool that can be safely carried yet is conveniently available without requiring a pocket or to be opened before use.

SUMMARY OF THE INVENTION

A hat with multifunctional bill portion has a sheath portion and a top sheath attachment portion is fitted over bill of a hat that has been trimmed to fit. A plurality of screws attach the multifunctional bill portion to the bill. The sheath has two magnets and an alignment portion to removably hold a bill tool such as a knife in place. The alignment portion fits within a matching finger portion of the bill tool and helps stabilize the tool within the multifunctional bill portion during use. A variety of bill tool portions may be selected to match a specific use such as knife, bottle cap opener, divot tool, wrench, screwdriver, etc.

Other features and advantages of the instant invention will become apparent from the following description of the invention which refers to the accompanying drawings.

DETAILED DESCRIPTION OF THE INVENTION

Figure 1:
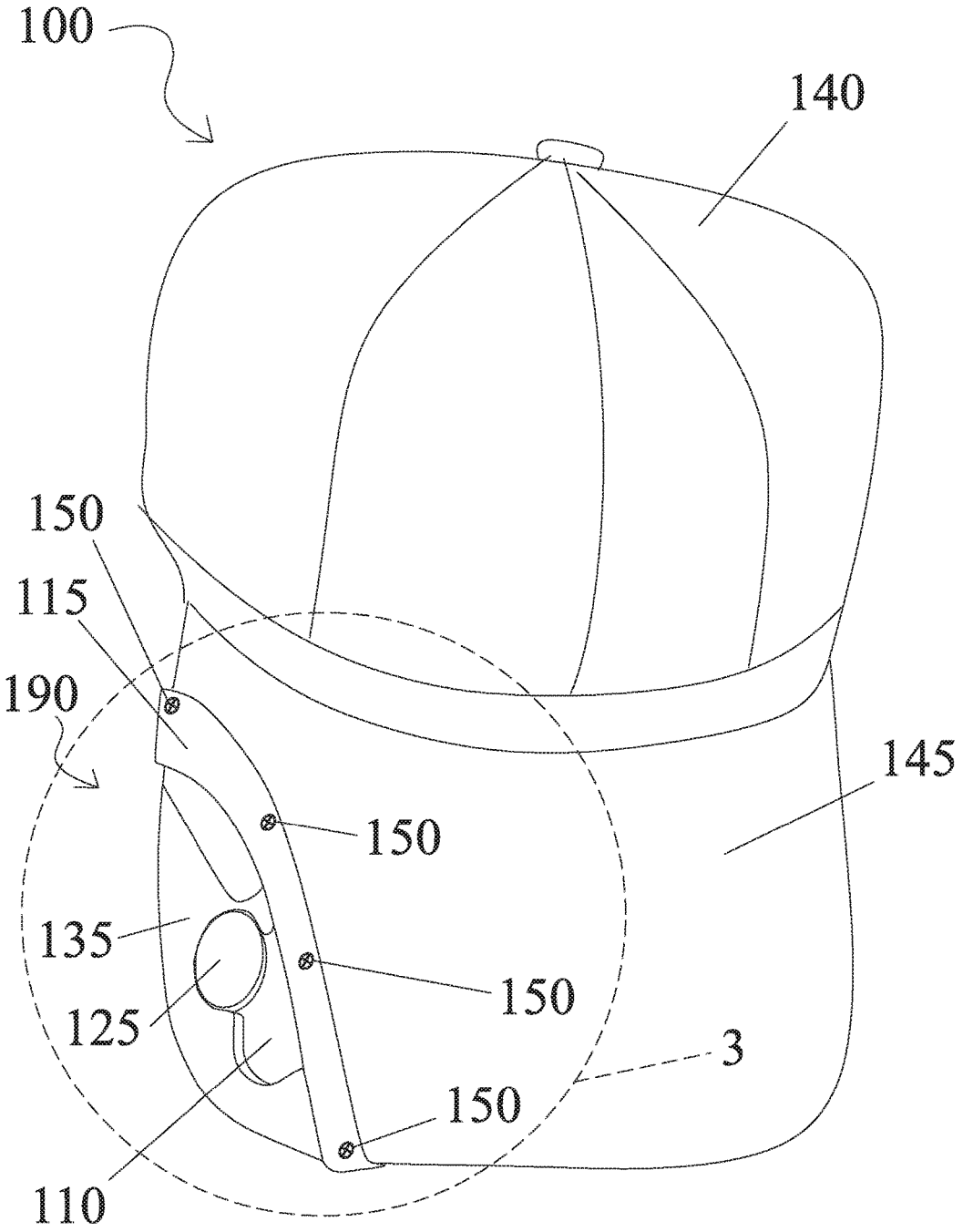
FIG. 1 is a perspective view of a hat with multifunctional bill portion with a bill knife attached according to an embodiment of the invention.

In the following detailed description of the invention, reference is made to the drawings in which reference numerals refer to like elements, and which are intended to show by way of illustration specific embodiments in which the invention may be practiced. It is understood that other embodiments may be utilized and that structural changes may be made without departing from the scope and spirit of the invention.

Figure 2:
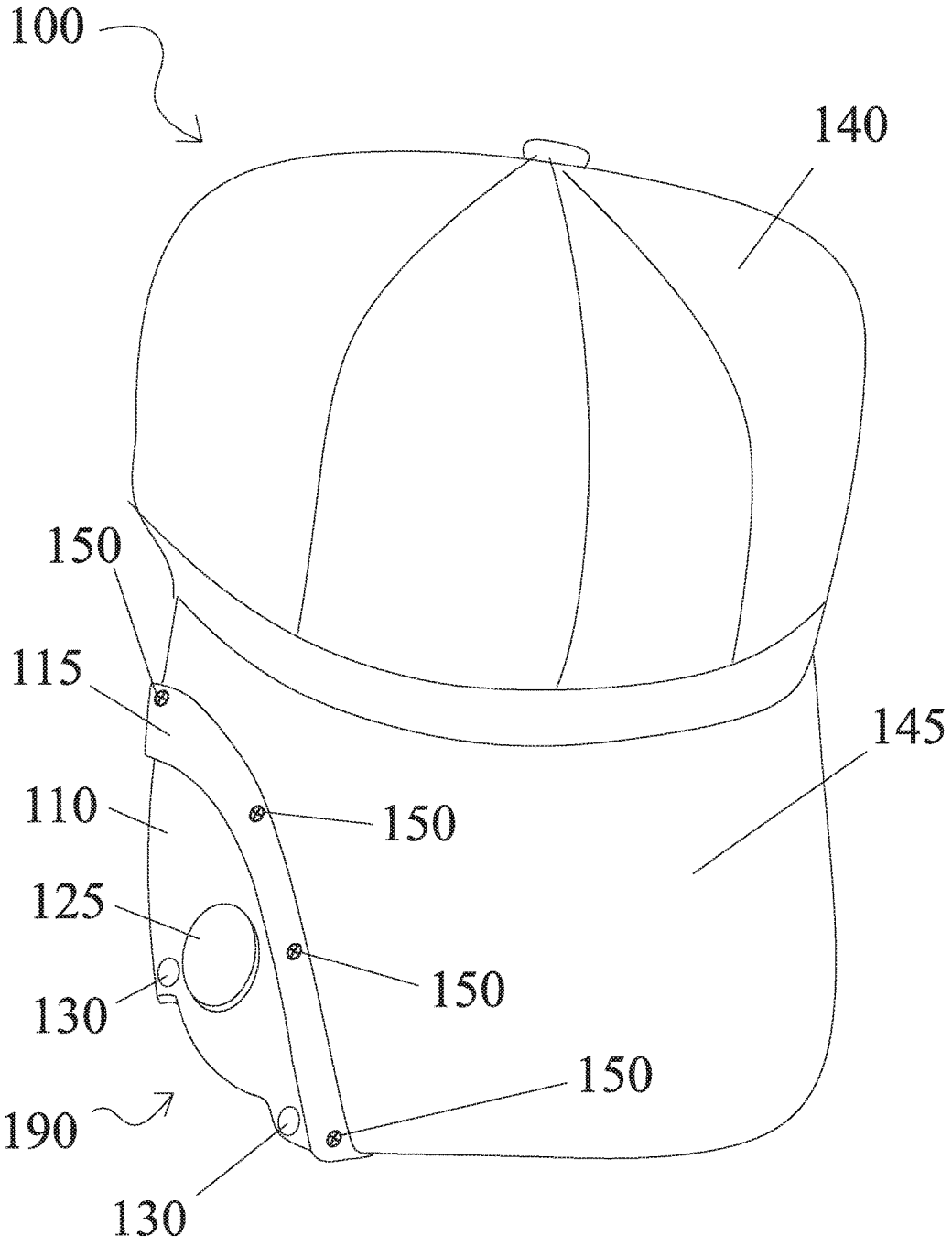
FIG. 2 is a perspective view of the hat with multifunctional portion shown in FIG. 1 with the bill knife removed.
Figure 6:
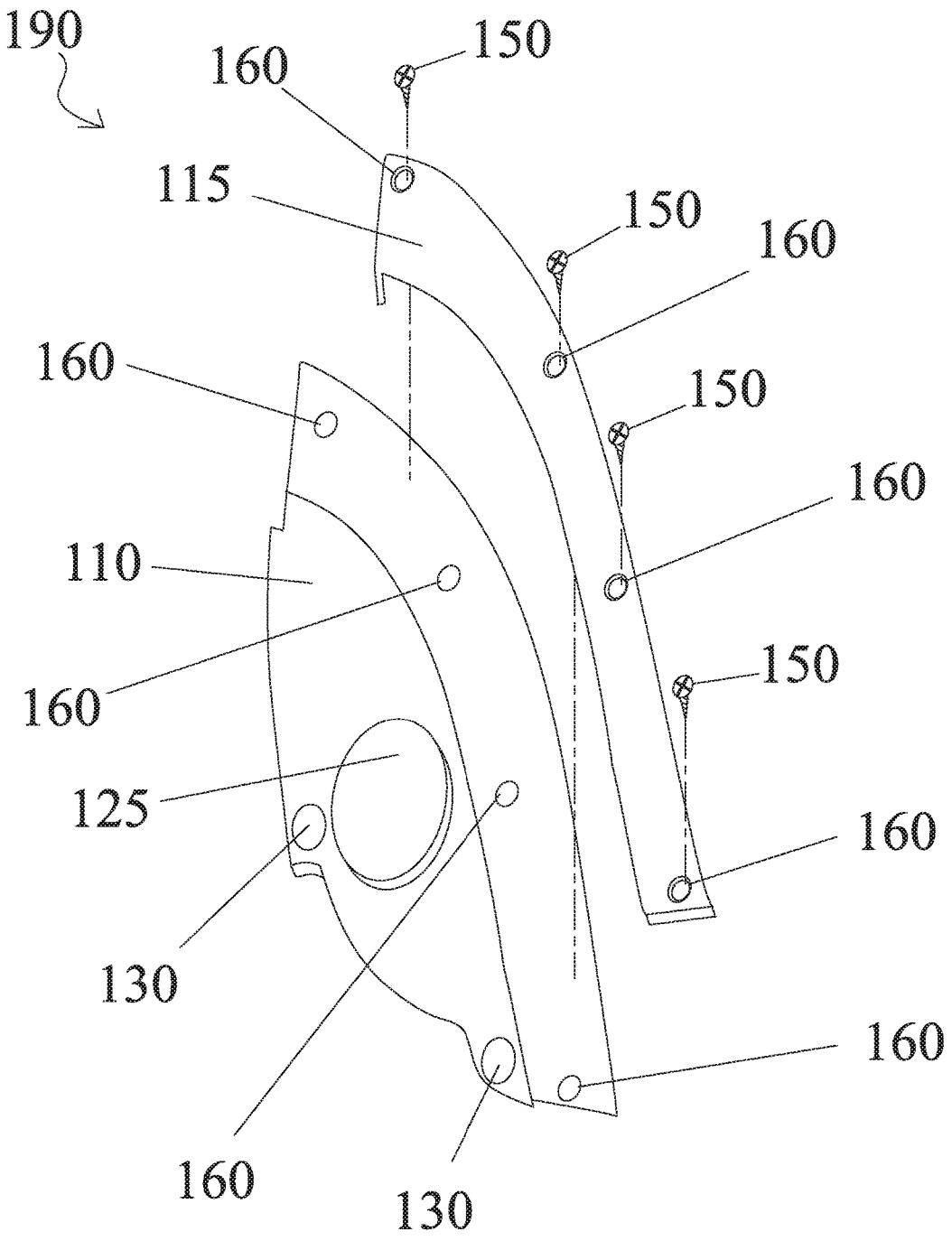
FIG. 6 is an assembly illustration of the multifunctional bill portion according to an embodiment of the invention.
Figure 7:
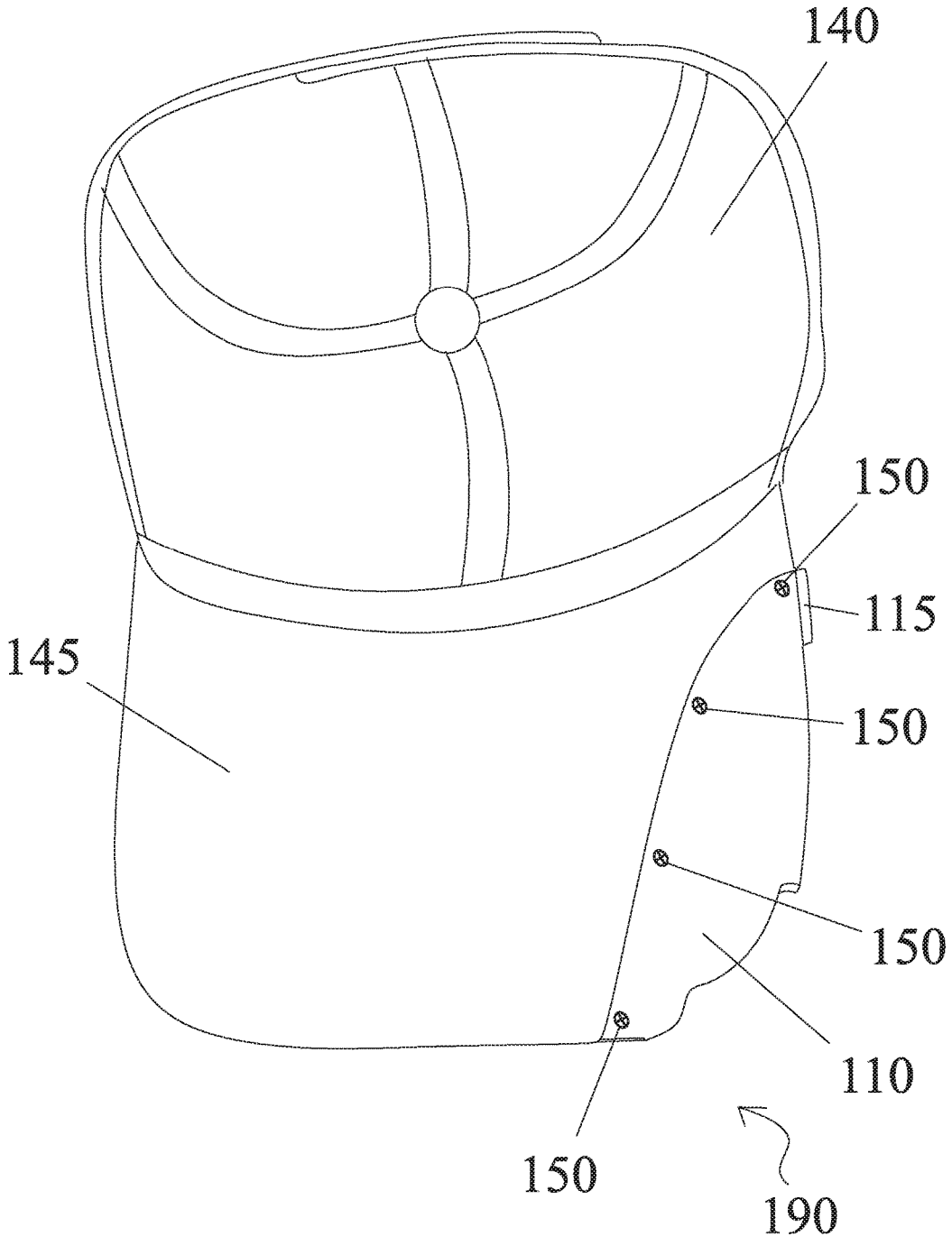
FIG. 7 is a bottom view of the multifunctional bill portion attached to the hat shown in FIG. 2.
Figure 8:
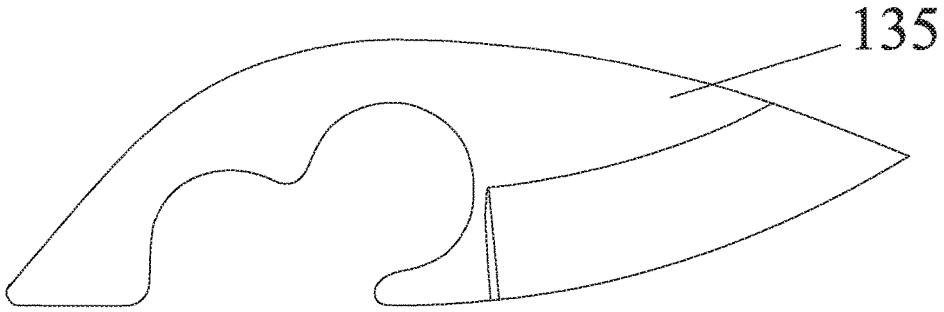
FIG. 8 is an illustration of the bill knife shown in FIG. 1.

Referring to FIGS. 1, 2 and 6, a hat with multifunctional bill portion 100 is shown having a hat 140 with a bill 145. A multifunctional bill portion 190 has a sheath portion 110 and a top sheath attachment portion 115. Sheath portion 110 has two magnets 130 mounted flush with a top portion of sheath portion 110 and an alignment portion 125 that is circular and fits within a respective circular finger portion of a bill knife 135 to hold and secure bill knife 135 to multifunctional bill portion 190. Of course the number of magnets is not critical and one magnet could be used as well as having more than two. Additionally, the shape of the magnets could have another geometry beside the circular magnets shown and would be understood to be within the scope of this disclosure.

A plurality of attachment screws 150 are used to secure multifunctional bill portion to bill 145 of hat 140. Of course other methods could be used to secure multifunctional bill portion 190 such as, but not limited to, glue, rivets, bolts, snaps, etc. as long as multifunctional bill portion 190 is securely attached to bill 145. A plurality of holes 160 are provide to allow attachment screws 150 to attach top sheath attachment portion 115 and sheath portion 110 to bill 145.

Figure 3:
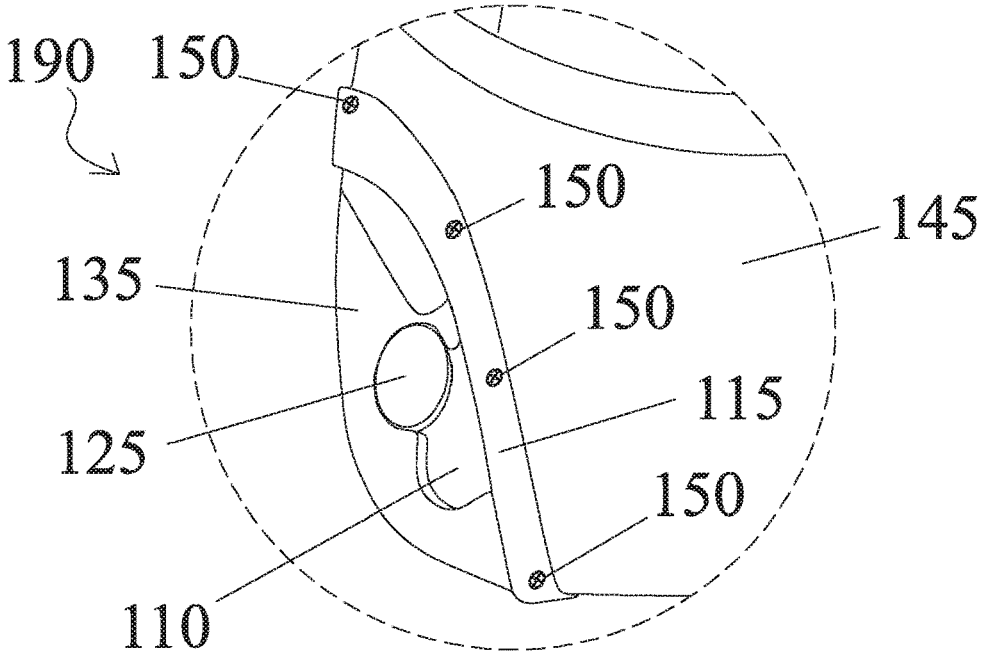
FIG. 3 is an enlarged view of the section shown in FIG. 1.
Figure 4:
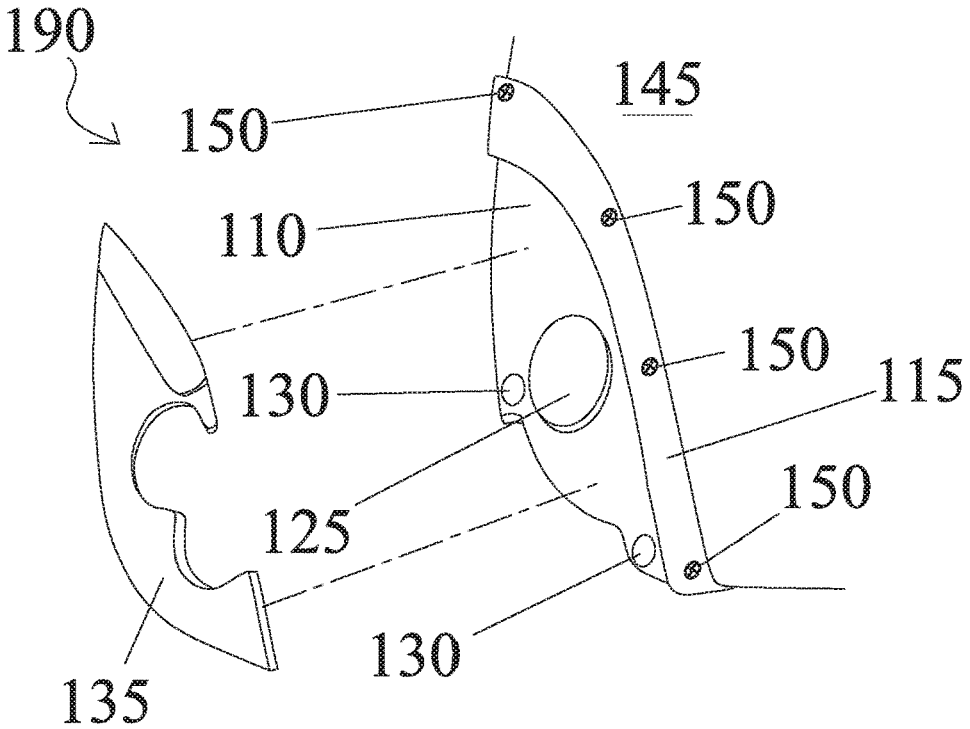
FIG. 4 is a partial view of the multifunctional portion shown in FIG. 3 illustrating how the bill knife fits within a sheath.
Figure 5:
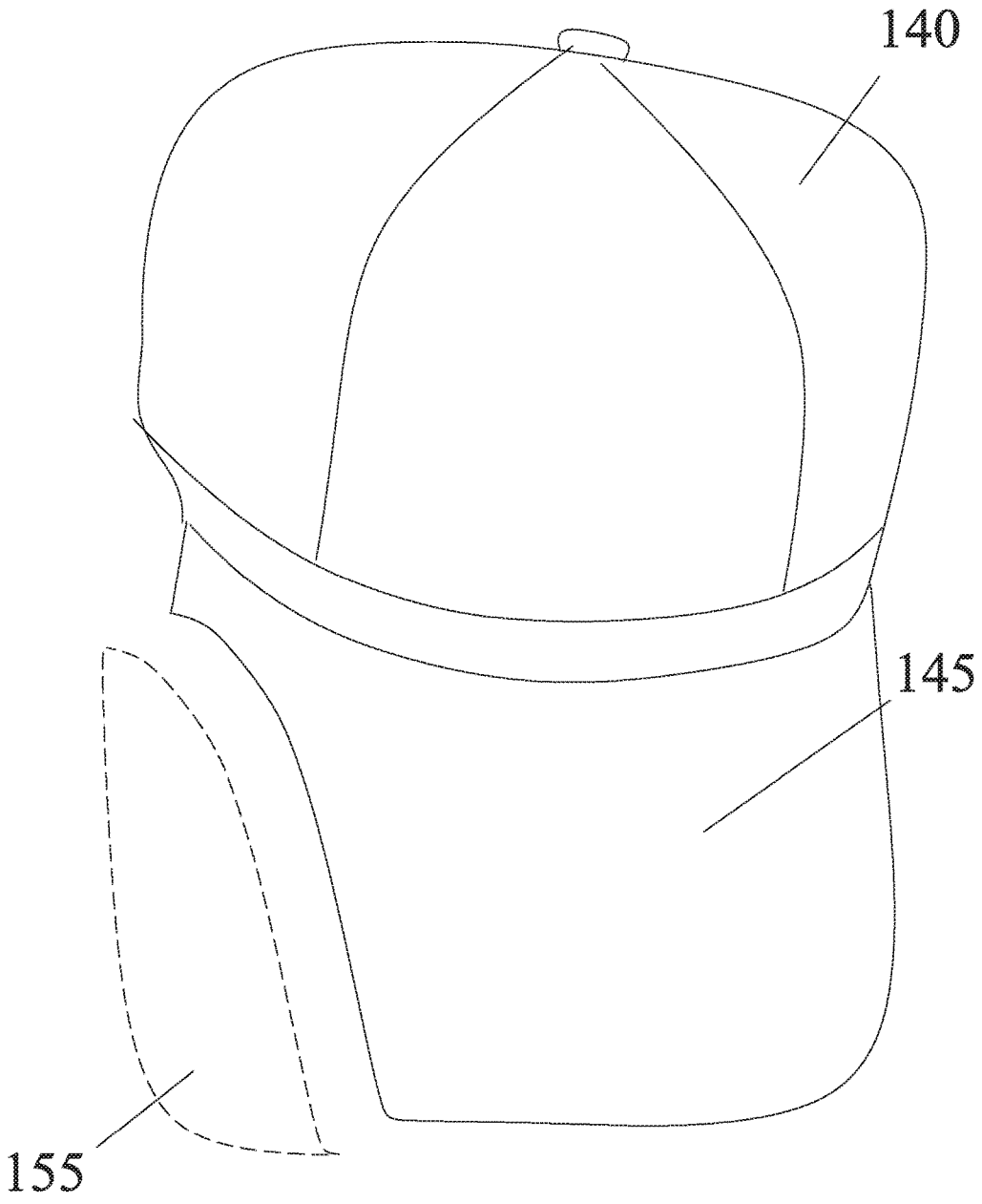
FIG. 5 is a perspective view of a hat being prepared to accept the multifunctional bill portion shown in FIG. 1.

Now referring to FIGS. 3 and 4, multifunctional bill portion 190 is shown with bill knife 135 inserted with sheath portion 110 with the blade fitting within a gap created when top sheath portion 115 is attached to bill 145. This protects the user from accidentally touching the blade when removing bill knife 135 as well as helping to secure bill knife within while not in use.

Referring now to FIGS. 1 through 6, hat 140 has bill 145 that is cut to fit multifunctional bill portion 190 and cut piece 155 is discarded. Next multifunctional bill portion 190 is fitted in the space created by removing cut piece 155 and screws 150 attach and secure multifunctional bill portion 190 to the remaining bill 145. In this way, multifunctional bill portion can be fitted to any hat that a user wants to modify without the need to buy a special hat. This may be done by a consumer, or it may be preinstalled by a manufacturer.

Figure 9:
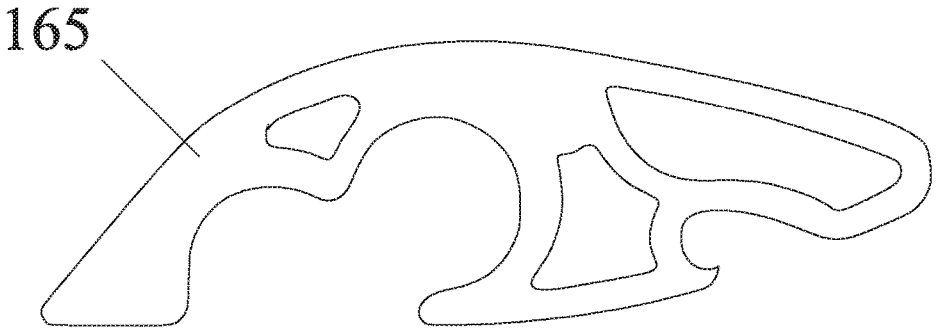
FIG. 9 is an illustration of a bill bottle opener that fits within the multifunction bill portion shown in FIG. 2.
Figure 10:
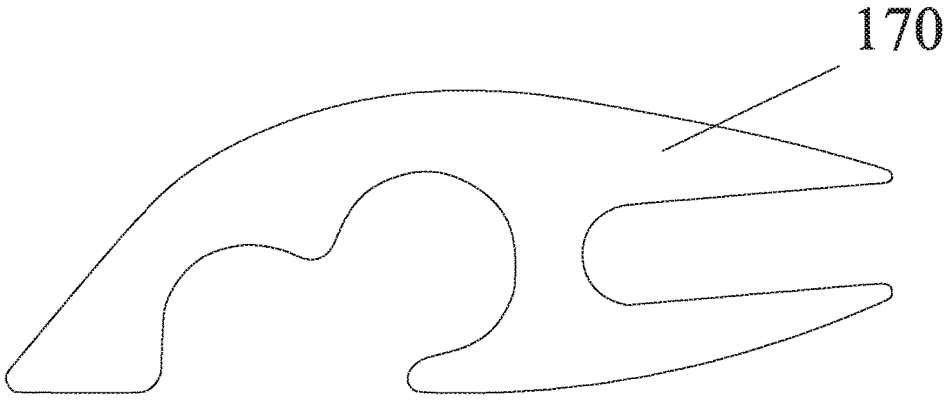
FIG. 10 is an illustration of a bill golf divot tool that fits within the multifunctional bill portion shown in FIG. 2.
Figure 11:
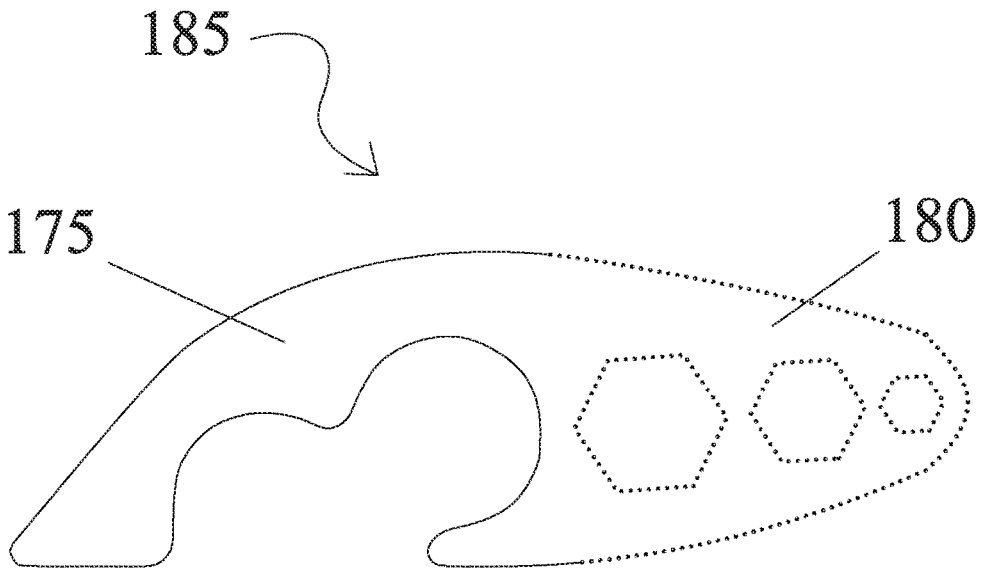
FIG. 11 is an illustration of a bill tool configured with a specialized tool portion.
Figure 12:
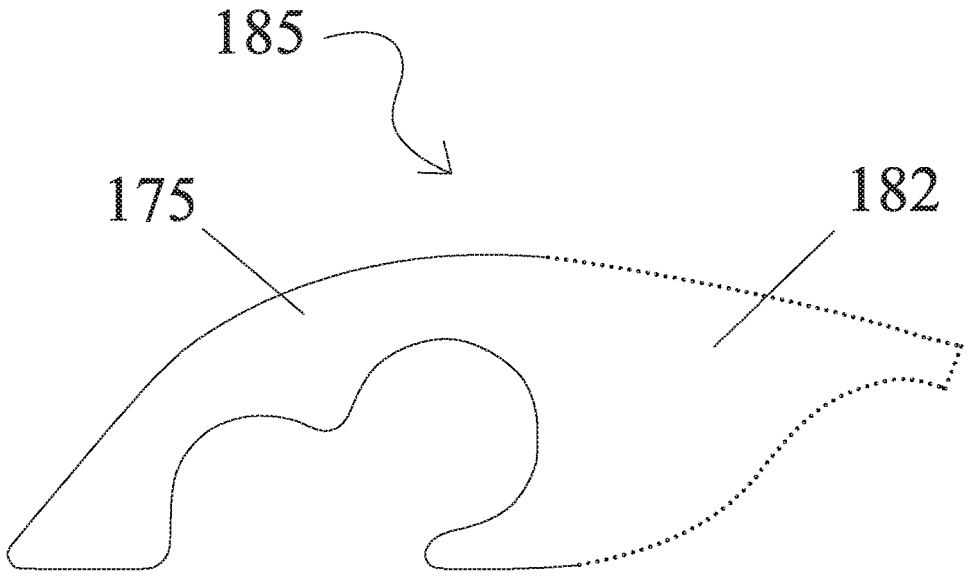
FIG. 12 is an illustration of a bill tool configured with a specialized tool portion.

Referring now to FIGS. 8 through 12, different bill tools are shown as examples of the kind of tools that may be used with the instant invention. A bill bottle cap opener 165 is shown in FIG. 9 and a bill golf divot tool 170 is shown in FIG. 10. To illustrate the versatility of the present invention, FIGS. 11 and 12 show in dotted lines that the particular tool can be modified to fit a finger portion 175 and a bill tool portion 180 and 182. Bill tool portion 180 illustrates a wrench and bill tool portion 182 illustrates a screwdriver. Of course the tools shown are representative and not meant to be exhaustive, rather demonstrate the versatility of the present invention to hold a variety of tools in order to enable the user to easily access the selected tool from a hat that he or she is wearing. Finger portion 175 has two circular cutout areas that allows a user to insert their fingers into the circular cutout areas to easily hold and use the tool as well as fitting over alignment portion 125 as discussed above.

Multifunctional bill portion 190 is made of plastic, but other suitable materials could be used as long as it can be formed in the proper shape. Bill knife 135 as well as any bill tool 185 is made of a magnetic material so that it is held in place with magnets 130; however, it is not necessary for bill tool 185 to be entirely magnetic and a composite material could be used as lone as finger portion 175 is magnetically attracted to magnets 130.

Although the instant invention has been described in relation to particular embodiments thereof, many other variations and modifications and other uses will become apparent to those skilled in the art.

What is claimed is:

1. A hat with multifunctional bill portion comprising:

a bill portion;

said bill portion having a cut out portion extending through an outer edge of said bill portion;

a sheath portion;

said sheath portion having an outside edge arcuate portion that is selected to match a shape of said cut out portion of said bill portion;

a top sheath attachment portion;

said top sheath attachment portion having a shape selected to match an inside edge of said sheath portion;

said sheath portion adapted to fit against said bill portion in a space created by said cut out portion;

a plurality of attachment means for securing said top sheath attachment portion to said sheath portion and to an edge of said bill portion in said space created by said cut out portion wherein said bill portion is sandwiched between said top sheath attachment portion and said sheath portion;

said sheath portion having a raised alignment portion on a sheath portion top surface;

at least one magnet disposed in said sheath portion top surface;

said at least one magnet being embedded within said sheath portion whereby said at least one magnet is flush with said sheath portion top surface;

a removable bill tool adapted to fit with said sheath portion; wherein when said removable bill tool is fit with said sheath portion, an original contour of said bill portion is restored;

said removable bill tool having a finger portion and a bill tool portion; and said finger portion having an alignment portion adapted to fit over said raised alignment portion.

2. The hat with multifunctional bill portion according to claim 1 wherein said removable bill tool has an outer edge that follows the contour of said sheath portion wherein said sheath portion fills in said cut out portion of said hat; wherein said hat has a full bill portion after installation of said sheath portion.

3. The hat with multifunctional bill portion according to claim 1 wherein said bill tool portion is a knife blade.

4. The hat with multifunctional bill portion according to claim 1 wherein said bill tool portion is a bottle opener.

5. The hat with multifunctional bill portion according to claim 1 wherein said bill tool portion is a golf divot tool.

6. The hat with multifunctional bill portion according to claim 1 wherein said plurality of attachment means are screws.

7. The hat with multifunctional bill portion according to claim 1 wherein said raised alignment portion is circular in shape.

8. The hat with multifunctional bill portion according to claim 1 wherein said alignment portion is circular in shape.

9. The hat with multifunctional bill portion according to claim 8 further comprising a circular shaped opening adjacent to said alignment portion and adapted to fit a user's finger.

10. The hat with multifunctional bill portion according to claim 1 wherein said at least one magnet is a rare-earth magnet.

* * * * *